US005672077A

United States Patent [19]

Wang et al.

[11] Patent Number: 5,672,077

[45] Date of Patent: Sep. 30, 1997

[54] LIGHT BULB SOCKET STRUCTURE HAVING A WATERTIGHT FEATURE

[76] Inventors: Shou Jing Wang, 8-2, Pai Tea Fen, 1 Ling, Pai Tea Li; Sher Yea Tai, 2F, No. 2, Lane 86, Hsin Kang Street, both of Chupei City, Hsinchu Hsien, Taiwan

[21] Appl. No.: 577,005

[22] Filed: Dec. 26, 1995

[51] Int. Cl.[6] ..... H01R 17/00

[52] U.S. Cl. ..... 439/619

[58] Field of Search ..... 439/619, 699.2, 439/280, 419

[56] References Cited

U.S. PATENT DOCUMENTS 3,130,921 4/1964 Morgan ..... 439/419 X 5,443,399 8/1995 Jing et al. ..... 439/619 OR 5,443,402 8/1995 Huang ..... 439/619 X 5,531,610 7/1996 Chen ..... 439/619 X

*Primary Examiner*—P. Austin Bradley

*Assistant Examiner*—Daniel Wittels

*Attorney, Agent, or Firm*—Morton J. Rosenberg; David I. Klein

[57] ABSTRACT

A light bulb socket structure is provided having a waterproof feature. In the socket structure, a resilient skirt of a light bulb holder and an annular flange of a light bulb seat produce a watertight joint, which cooperates with waterproof end cap or plug attached to the lower end of the light bulb seat to provide protection for electrical connection portions of a light bulb installed on the socket against water penetration.

3 Claims, 6 Drawing Sheets

LIGHT BULB SOCKET STRUCTURE HAVING A WATERTIGHT FEATURE

BACKGROUND OF THE INVENTION

Conventional decorative light bulb series are used outdoors on many occasions. For safety in use, the light bulb structure must have a waterproof feature. However, in a light bulb socket structure of the prior art, in which connections between components are simply made by naked joints, it is hard to acquire a watertight effect. Once moisture penetrates into the socket and impairs the contact portions of electrical parts, it will result in electrical shorting and damages, and even put the user in danger.

SUMMARY OF THE INVENTION

The primary object of this invention is to provide a light bulb socket structure that can furnish effective waterproof protection for the light bulb mounted thereon by means of improved bulb holders and bulb seats in association with waterproof end caps. Preferred embodiments now will be explained in detail in the following description with reference to the accompanying drawings.

DETAILED DESCRIPTION OF THE PREFERRED EMBODIMENTS

Figure 1:
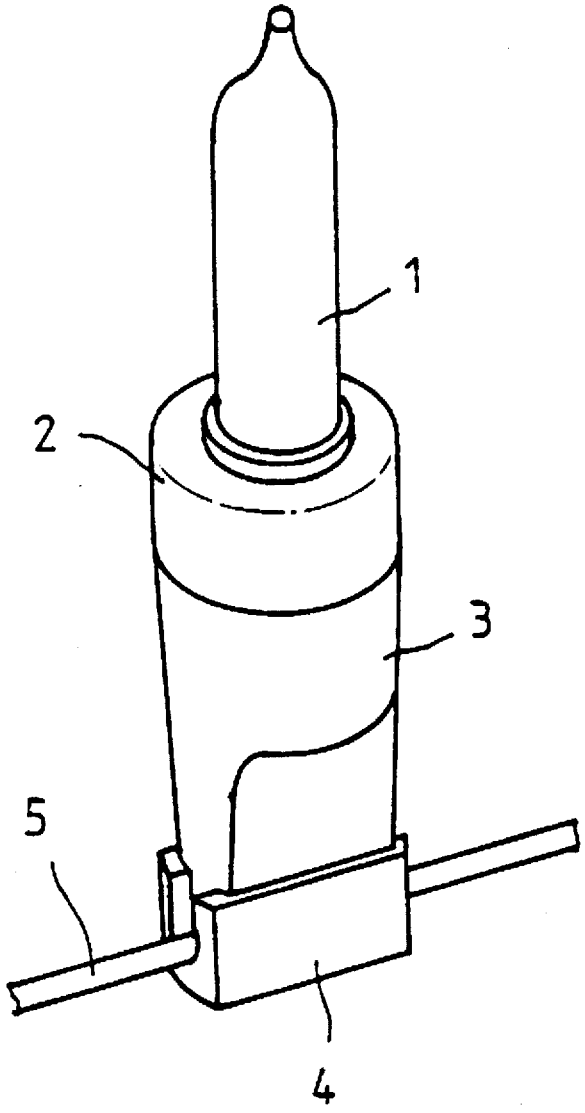
FIG. 1 shows a perspective representation of a light bulb socket structure of the invention.
Figure 2:
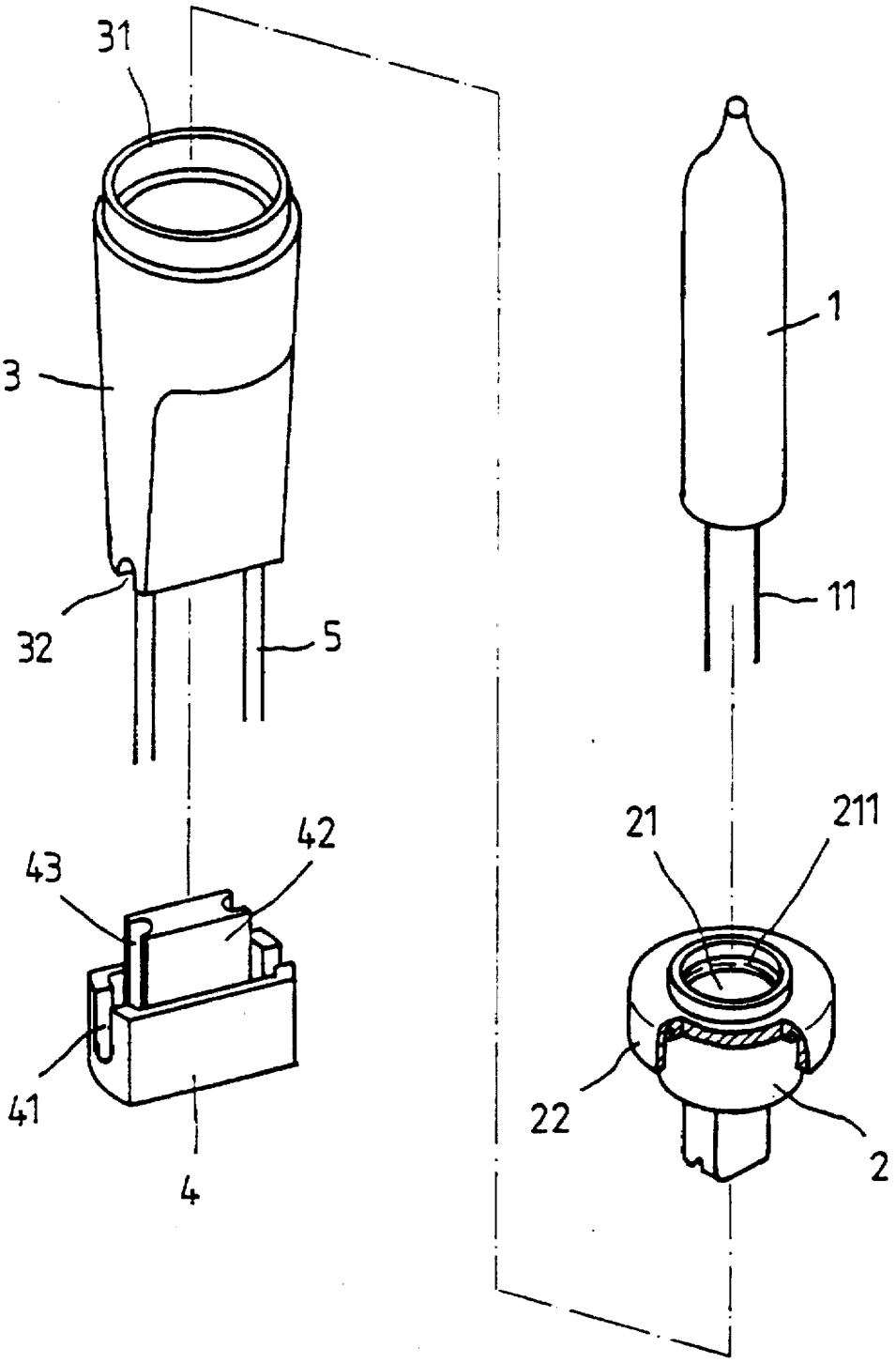
FIG. 2 is an exploded view of the light bulb socket structure shown in FIG. 1.
Figure 3:
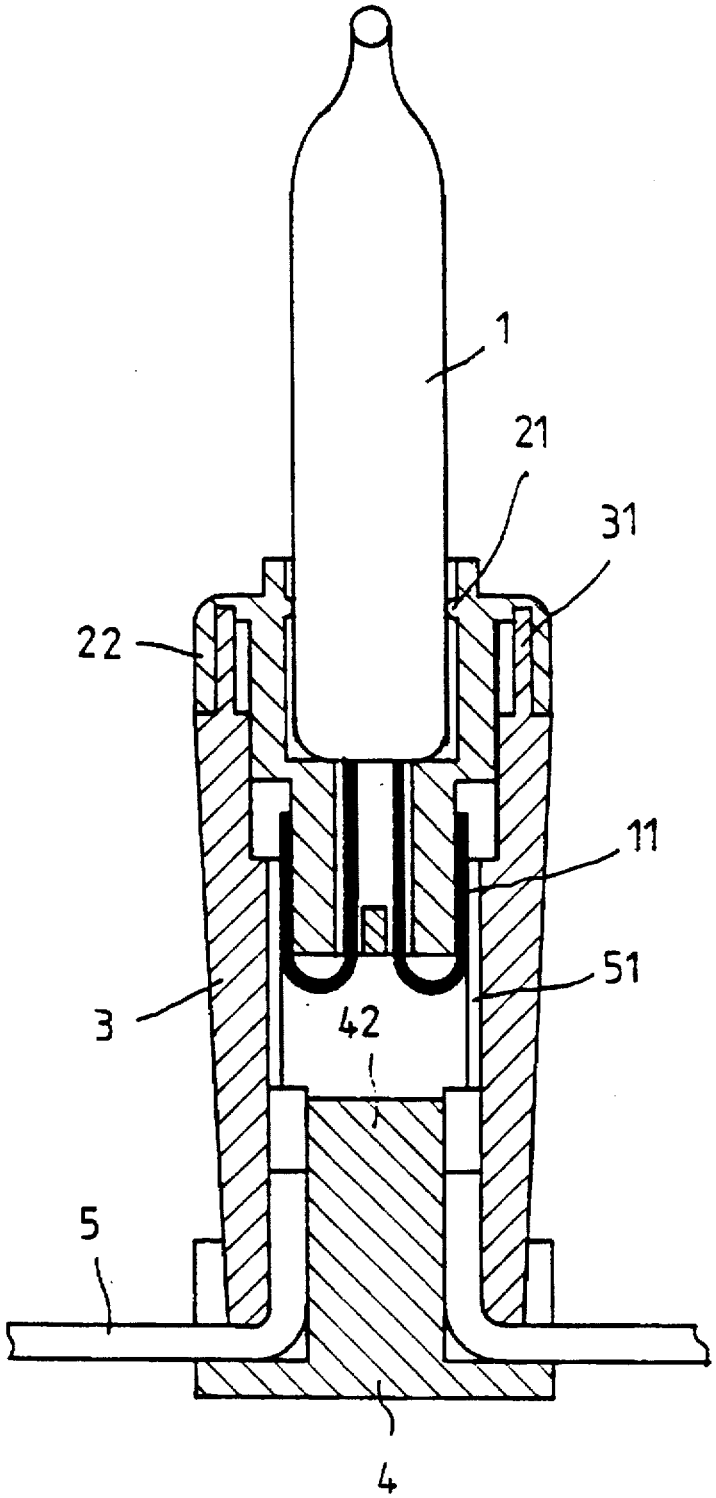
FIG. 3 shows in a cross-sectional view the light bulb socket structure of FIG. 1 in assembled form.

First, FIGS. 1 through 3 show an embodiment of a light bulb seat structure composed of a light bulb 1, a light bulb holder 2, a light bulb seat 3, a waterproof end cap 4, and conductor wires 5 connected to the light bulb seat 3. On the bulb holder 2 there is coaxially arranged a hole 21 that is sized to embrace snugly the outer periphery of a light bulb 1. As the light bulb 1 is mounted in the bulb holder 2 and an annular flange 211 is provided on the top of the light bulb holder 2 to go around the light bulb 1, a watertight effect is achieved. In addition, the outer periphery of the light bulb holder 2 is designed to be a skirt 22 having an elastic property. The light bulb seat 3 is provided, on its top, with an engaging shoulder 31 designed to allow the skirt 22 of the light bulb holder 2 to embrace the outer surface of the engaging shoulder 31. By joining the skirt 22 and the engaging shoulder 31, the light bulb holder 2 and the light bulb seat 3 are combined.

Further, the light bulb seat 3 is provided on both sides of its lower end with a groove 32 for furnishing room to allow an outwardly bent conductor wire 5 to pass therethrough while a waterproof end cap 4 is attached to the lower end of the light bulb seat 3. The waterproof end cap 4 is also furnished on both sides with a semi-circular groove 41 corresponding to the grooves 32 on the light bulb seat 3 to form passages for the conductor wires 5. The middle portion of the waterproof end cap 4 is equipped with a joining seat 42 that protrudes into the interior of the light bulb seat 3 to secure conductor wires 5 by semi-circular grooves 43 arranged on both sides thereof. Therefore, the whole structure of the light bulb socket of the present invention forms a sealed space where the contact portions between the lead wires 11 of the light bulb 1 and the conductor plates 51 of electrical wires 5 are protected, preventing moisture penetration and electric shorting.

Figure 4:
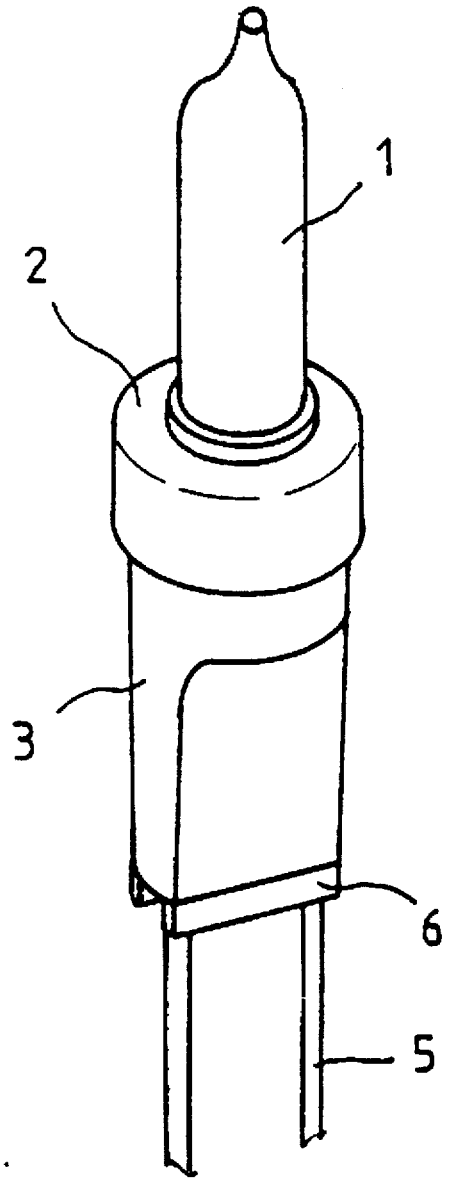
FIG. 4 shows the outer appearance of another embodiment of a light bulb socket structure according to the invention.
Figure 5:
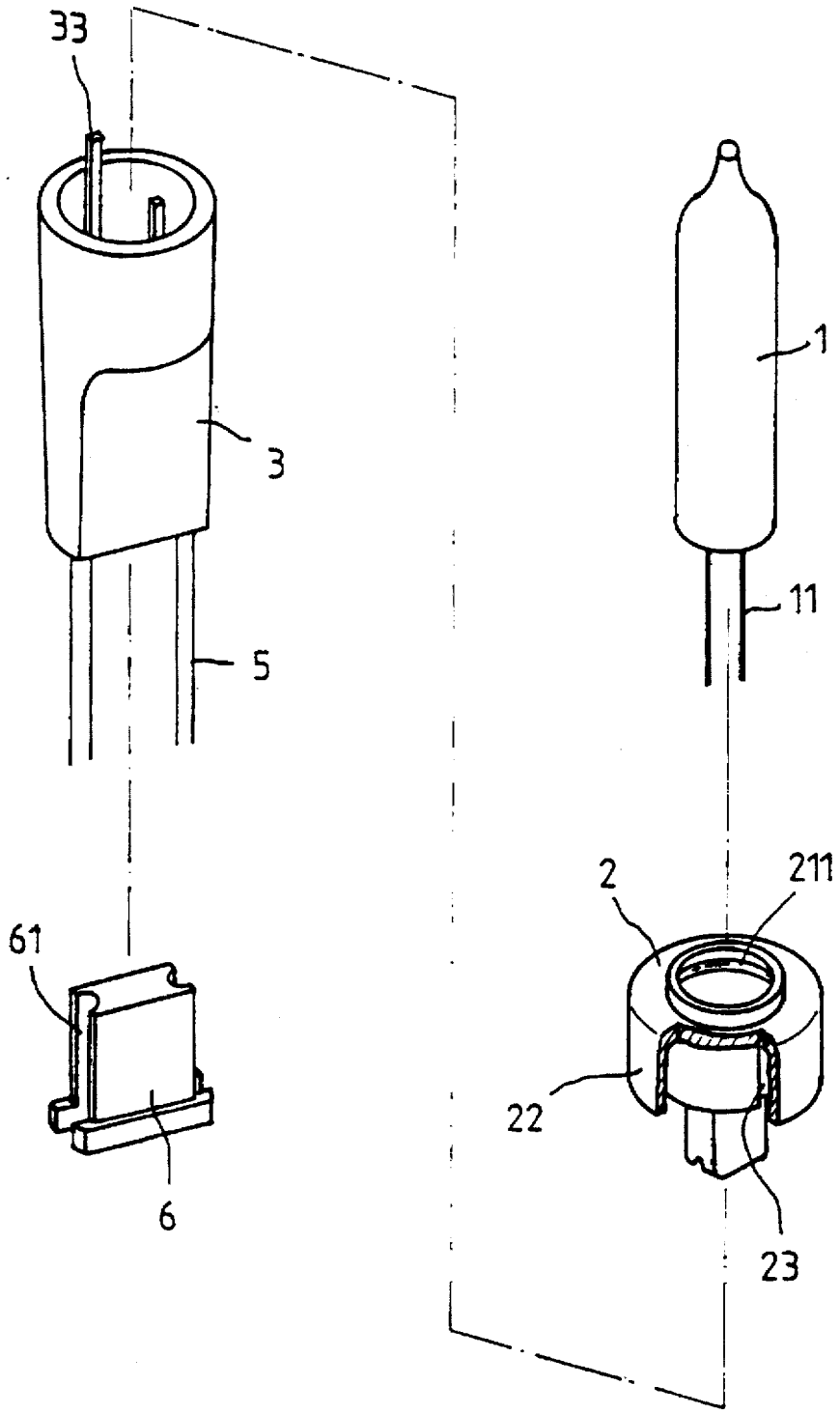
FIG. 5 is an exploded view of the light bulb socket structure shown in FIG. 4.
Figure 6:
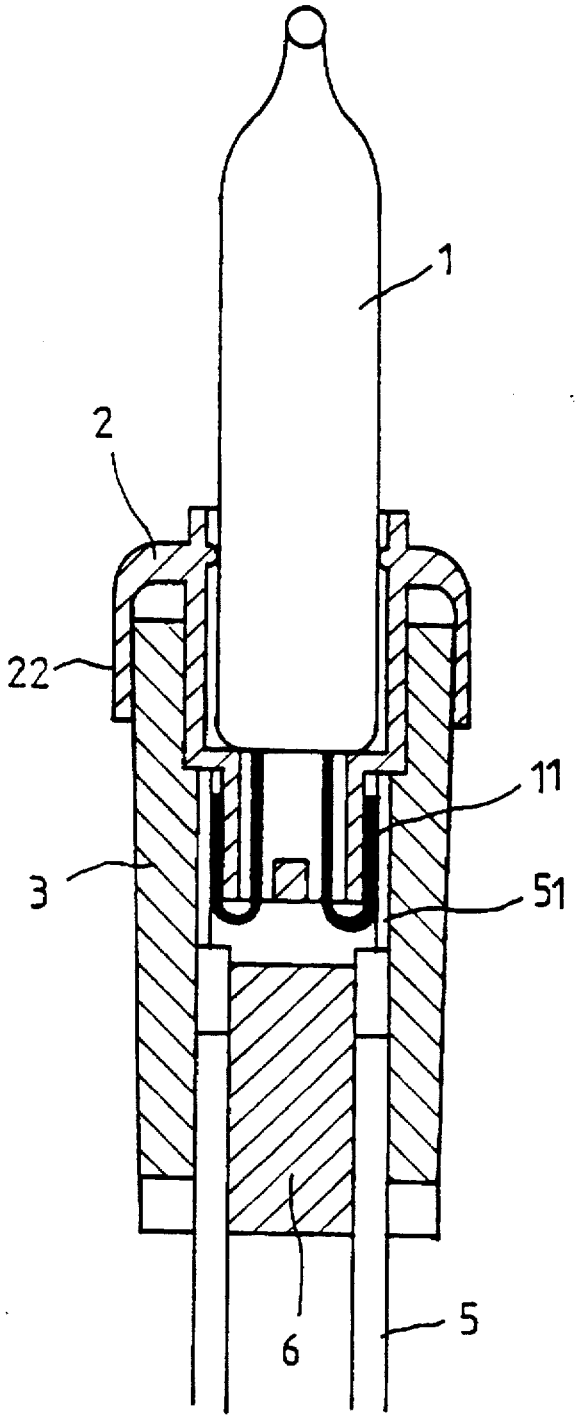
FIG. 6 is a cross-sectional view of the light bulb socket structure shown in FIG. 4.

FIGS. 4 through 6 show another embodiment of the invention that has the same configurations of the light bulb 1 and the light bulb holder 2 as the previously described embodiment, except a locating groove 23 is added on each of two, 180 degree separated, opposite sides of the periphery of the bulb holder. The light bulb seat 3 has corresponding positioning lugs 33 disposed on two, 180 degree, opposite sides of the inside surface thereof for mating with the two locating grooves 23. The top of the bulb seat 3 extends under the resilient skirt 22 of the bulb holder 2 to form a watertight joint. The light bulb socket is also provided within additional waterproof means in the form of a plug 6 with a semi-circular groove 61 formed on both sides thereof that is so designed that when the plug 6 is inserted into the lower portion of the light bulb seat 3, with the semi-circular grooves 61 tightly securing electrical wires 5, such forms a closed lower end of the bulb seat. The contact portions between the lead wires 11 of the light bulb 1 and the conductor plates 51 of electrical wires are thereby protected from moisture penetration. Thus, the shortcomings of wetting and shorting that are frequency found in a traditional structure are avoided.

In brief, the improved light bulb socket structure of the present invention can effectively overcome the shortcomings of prior art structures and achieve a complete waterproof effect by using bulb holders, bulb seats, and waterproof end caps or plugs in combination.

What is claimed is:

1. A light bulb socket structure having a waterproof feature, comprising a light bulb, a light bulb holder, a light bulb seat, and a watertight end cap, wherein said light bulb holder is coaxially provided with a hole around which there is provided an annular flange on a top portion of said holder, said annular flange being dimensioned to closely embrace an outer periphery of said light bulb for a watertight effect and has an elastic skirt around an outer periphery of said light bulb holder;

said light bulb seat being provided on a top portion thereof with an engaging shoulder that allows said light bulb holder to be assembled thereon with said engaging shoulder abutting against an underside portion of said skirt to produce a watertight joint and is further provided with a groove on each of two opposite sides of a lower portion thereof; and, said watertight end cap being capable of receiving the lower portion of said light bulb seat and also has a groove formed on each of two opposite sides thereof corresponding to said grooves on said light bulb seat to provide a passage way for electrical wires to extend therethrough, said end cap having a central portion formed with a joining seat which protrudes into an interior space of said light bulb seat as said end cap is attached to said light bulb seat to secure the electrical wires in position and to achieve a watertight effect.

2. The light bulb socket structure as claimed in claim 1, wherein said light bulb holder has two locating grooves provided on opposite sides of a peripheral surface thereof, said two locating grooves being spaced 180 degree apart, said light bulb seat having a pair of corresponding positioning lugs arranged on an inside surface thereof for mating with said locating grooves with the resilient skirt of said light bulb seat straddling on the top of said light bulb seat.

3. A light bulb socket structure having a waterproof feature, comprising a light bulb a light bulb holder, a light bulb seat, and a watertight plug, wherein said light bulb holder is coaxially provided with a hole around which there is provided an annular flange on a top portion of said holder, said annular flange being dimensioned to closely embrace an outer periphery of said light bulb for a watertight effect and has an elastic skirt around an outer periphery of said light bulb holder:

said light bulb seat being provided on its a top portion thereof with an engaging shoulder that allows said light bulb holder to be assembled thereon with said engaging shoulder abutting against an underside portion of said skirt to produce a watertight joint and is further provided with a groove on each of two opposite sides of a lower portion thereof; and, said watertight plug having a semi-circular groove formed on each of two opposite sides thereof, said watertight plug being insertable into a lower end of said light bulb seat with the semi-circular grooves securing electrical wires connected to the light bulb seat to form a watertight end.

* * * * *